United States Patent [19]

Neyret

[11] Patent Number: 4,594,866

[45] Date of Patent: Jun. 17, 1986

[54] LOCK CYLINDER WITH A PIVOTABLE CLOSURE

[75] Inventor: Guy Neyret, Oullins, France

[73] Assignee: Neiman S.A., Courbevoie, France

[21] Appl. No.: 750,977

[22] PCT Filed: Nov. 6, 1982

[86] PCT No.: PCT/EP82/00240

§ 371 Date: Jun. 30, 1983

§ 102(e) Date: Jun. 30, 1983

[87] PCT Pub. No.: WO83/01808

PCT Pub. Date: May 26, 1983

Related U.S. Application Data

[63] Continuation of Ser. No. 518,301, Jun. 30, 1983, abandoned.

[30] Foreign Application Priority Data

Nov. 12, 1981 [FR] France ..... 81 21348

[51] Int. Cl.[4] ..... E05B 17/18

[52] U.S. Cl. ..... 70/455; 70/423

[58] Field of Search ..... 70/455, 423

[56] References Cited

U.S. PATENT DOCUMENTS

| | | | |
|---|---|---|---|
| 2,680,965 | 6/1954 | Jacobi | 70/455 |
| 2,690,071 | 9/1954 | Jacobi | 70/455 |
| 2,747,397 | 5/1956 | Jacobi | 70/455 |
| 3,705,508 | 12/1972 | Fritsch et al. | 70/455 |
| 4,006,616 | 2/1977 | Rubner et al. | 70/455 |

FOREIGN PATENT DOCUMENTS 2160024 6/1973 France .

*Primary Examiner*—Robert L. Wolfe
*Assistant Examiner*—Russell W. Illich
*Attorney, Agent, or Firm*—Karl F. Ross; Herbert Dubno

[57] ABSTRACT

The lock cylinder (1) has in its widened head (2) a pivotable closing flap (4) which closes the insertion orifice of the key channel. One end (8) of a torsion spring (7) rests against the face of the closing flap (4) directed towards the key channel. Before assembly, the other end (12) of the torsion spring (7) projects above the outer surface of the cylinder (1) through a slit (13) in the head (2) of the cylinder (1), is bent round after assembly and interacts with a stop (14) connected to the cylinder (1). This design of the lock cylinder makes it easier to assemble it.

1 Claim, 3 Drawing Figures

LOCK CYLINDER WITH A PIVOTABLE CLOSURE

This is a continuation of co-pending application Ser. No. 518,301 filed on June 30, 1983, now abandoned.

CROSS REFERENCE TO RELATED APPLICATIONS

This application is an international phase application corresponding to the Patent Cooperation Treaty international application PCT/EP 82/00240 filed Nov. 6, 1982 and based in turn, on the French national application No. 81/21348 of Nov. 12, 1981 under the International Convention.

FIELD OF THE INVENTION

My present invention relates to a lock cylinder with a pivotable closure.

BACKGROUND OF THE INVENTION

A lock cylinder can have a pivotable closure which is located behind the cylinder cover and which consists of a closing flap which closes the insertion orifice of the key channel, the flap being pivotable about an axis at right angles to the longitudinal axis of the cylinder, one end of a torsion spring resting against the face of the closing flap directed towards the interior of the key channel.

Known lock cylinders of this type are difficult to assemble, especially because a torsion spring is used. A torsion spring of this type has to be tensioned when the closing flap is installed in the cylinder, and the entire unit has to be held in place during the fastening of the cylinder cover, which retains the unit as a whole. The quality of protection achieved by means of a pivotable closing flap necessitates making assembly simpler, thus allowing mass-production at a competitive price.

OBJECT OF THE INVENTION

It is an object of this invention to provide an improved closure assembly for a lock cylinder obviating the aforementioned drawback.

SUMMARY OF THE INVENTION

In a lock cylinder of the type mentioned in the introduction, this object is achieved, according to the invention, when, before assembly, the second end of the torsion spring projects above the outer surface of the lock cylinder and, after being bent round, interacts with a stop connected to the cylinder.

The lock cylinder according to the invention therefore allows the torsion spring, the closing flap and the cylinder cover to be assembled without the spring being tensioned; the spring is tensioned only after assembly and after the cylinder cover has been fastened.

BRIEF DESCRIPTION OF THE DRAWING

The invention is explained in more detail with reference to the drawing, in which.

SPECIFIC DESCRIPTION

Figure 1:
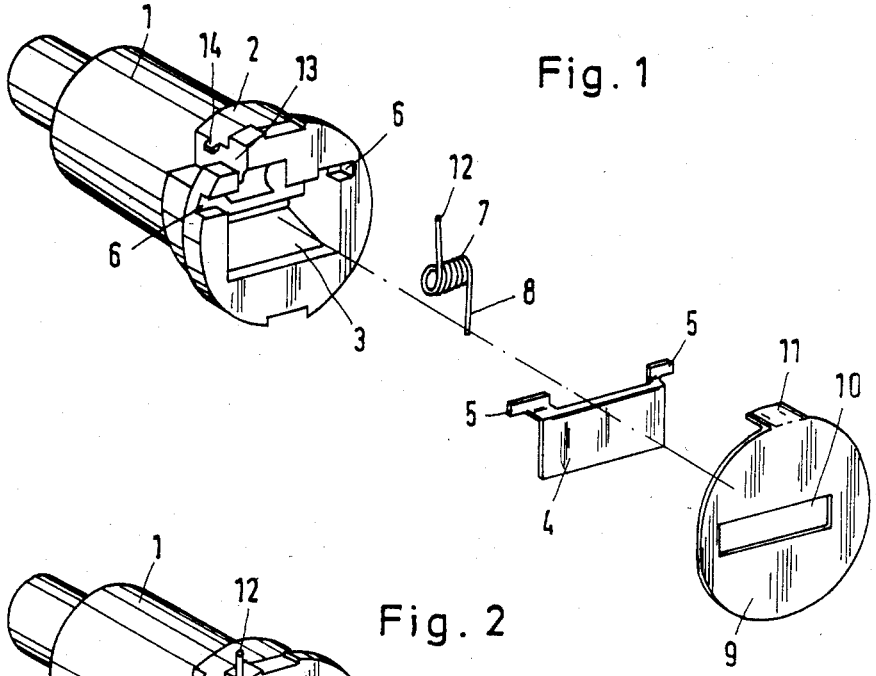
FIG. 1 shows an exploded persepctive view of a lock cylinder according to an exemplary embodiment of the invention.

The lock cylinder 1, especially a cylinder core, has a widened head 2 in which is formed an axial recess 3 which opens into the key channel (not shown). Located in the recess 3 is a closing flap 4 with two lateral lugs 5 which are pivotable in two clearances 6 in the head 2 of the cylinder. One end 8 of a torsion spring 7 rests against the face of the closing flap 4 directed towards the key channel. This helical cylindrical torsion spring 7 lies with its axis parallel to the axis of rotation of the closing flap and, like the latter, at right angles to the longitudinal axis of the cylinder.

A cylinder cover 9 which has an orifice 10 for the insertion of the key and which retains the closing flap 4 and the spring 7 in the recess 3 is mounted on the cylinder head 2 by bending over a fastening plate or tab 11.

Figure 2:
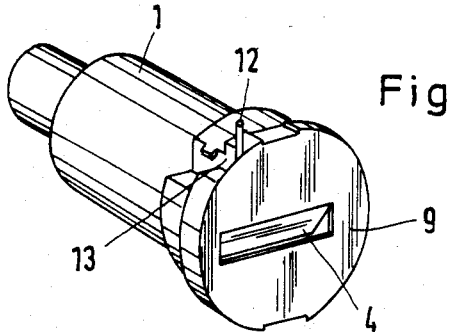
FIG. 2 shows a perspective view of the cylinder illustrated in FIG. 1, after assembly, but before the spring is tensioned.

When the lock cylinder is assembled, the second end 12 of the spring 7 is introduced into an outward-opening axial slit 13 in the front end of the cylinder head 2; this slit opens at one end into the recess 3 and at the other end onto the periphery of the head 2. The length of the end 12 of the spring 7 is such that this end projects above the periphery of the head 2 approximately radially or parallel to a radial line (FIG. 2). Assembly can therefore be carried out by means of the successive insertion of the spring 7 until it stops, the closing flap 4 and the cylinder cover 9 parallel to the longitudinal axis of the lock cylinder 1.

Figure 3:
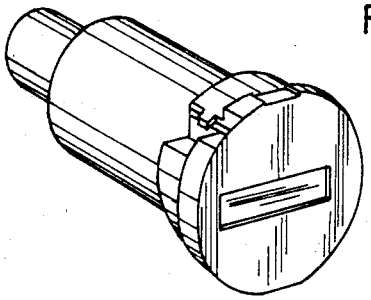
FIG. 3 shows a view of the cylinder similar to FIG. 2, but with the spring tensioned.

After the cylinder cover 9 has been fastened, the end 12 of the spring 7 is bent round into the slit 13, the spring 7 being tensioned; at the same time, its end 12 slides over a lug 14 in the gap 13. When the end 12 of the spring has slid over the lug 14, it only needs to be brought under this lug, which constitutes a stop in the form of a hook, in order to keep the spring 7 tensioned (FIG. 3). The lock cylinder 1 assembled in this way can now be handled without risk.

I claim:

1. A lock cylinder comprising:

a lock cylinder body formed with a passage adapted to receive a key, a head at one end of said body, a rectangular recess provided in an end of said head in line with said passage and having a pair of extensions along one edge of said recess, and a slot formed axially in said head and communicating with said edge between the interior of said recess and the exterior of said head along the outer periphery thereof;

a torsion spring received in said recess and having one leg received in said slot and projecting outwardly from said head therethrough, and another leg lying within said recesss;

a rectangular flap received in said recess and having a pair of lugs projecting into said extensions for pivotally mounting said flap in said recess whereby said other leg lies along an inner surface of said flap;

a cover plate affixed on said head, registering with and covering only said end, overlying said recess and said flap, and having a window aligned with said passage so that insertion of a key through said window deflects said flap inwardly against the force of said spring said cover plate being affixed to said head by a tab bent over said head; and a circumferentially projecting hook formation provided on said head adjacent said slot, said one leg having an axially bent end exposed along said periphery underlying said formation and braced thereagainst to stress said spring whereby said spring can be stressed only after it has been affixed on said head to cover said spring by the bending of said one leg beneath said formation.

* * * * *